United States Patent [19]

Da Silva et al.

[11] Patent Number: 5,030,362

[45] Date of Patent: Jul. 9, 1991

[54] PROCESS FOR STRIPPING LIQUID SYSTEMS AND SPARGER SYSTEM USEFUL THEREFOR

[75] Inventors: Pauliran Da Silva; Silvio Balestieri; Francesco Cerbino; Augusto P. Queiroz, all of Rio de Janeiro, Brazil; Theodore V. Kowalchyn, Scotch Plains, N.J.

[73] Assignee: Exxon Chemical Patents Inc., Linden, N.J.

[21] Appl. No.: 396,045

[22] Filed: Aug. 21, 1989

[51] Int. Cl.[5] ..... B01D 17/035

[52] U.S. Cl. ..... 210/774; 210/767; 261/76; 261/122; 261/DIG. 75

[58] Field of Search ..... 210/774, 739, 742; 261/122, 76, DIG. 75

[56] References Cited

U.S. PATENT DOCUMENTS

| | | | |
|---|---|---|---|
| 1,405,775 | 2/1922 | Friedrichs | 261/122 |
| 2,250,295 | 7/1941 | Coleman | 261/21 |
| 2,639,131 | 5/1953 | Coombs | 261/122 |
| 3,644,231 | 2/1972 | Maruya et al. | 260/2.5 F |
| 3,958,945 | 5/1976 | Takahashi | 23/259 |
| 3,970,731 | 7/1976 | Oksman | 261/122 |
| 3,978,176 | 8/1976 | Voegeli | 261/122 |
| 4,105,725 | 8/1978 | Ross | 261/122 |
| 4,261,932 | 4/1981 | Ewing et al. | 261/122 |
| 4,399,028 | 8/1983 | Kile et al. | 209/164 |
| 4,655,915 | 4/1987 | Carpinone | 210/169 |
| 4,735,709 | 4/1988 | Zipperian | 209/164 |
| 4,818,446 | 4/1989 | Schreiber et al. | 261/122 |

*Primary Examiner*—W. Gary Jones
*Assistant Examiner*—David A. Reifsnyder
*Attorney, Agent, or Firm*—M. L. Alter

[57] ABSTRACT

Undesirable materials, such as unreacted raw materials and by-products, are stripped from liquid systems by delivering a compressed, inert gas through the pores of a sintered porous sparger element and into the liquid system in the form of very small gas micro bubbles.

9 Claims, 2 Drawing Sheets

FIG. 3
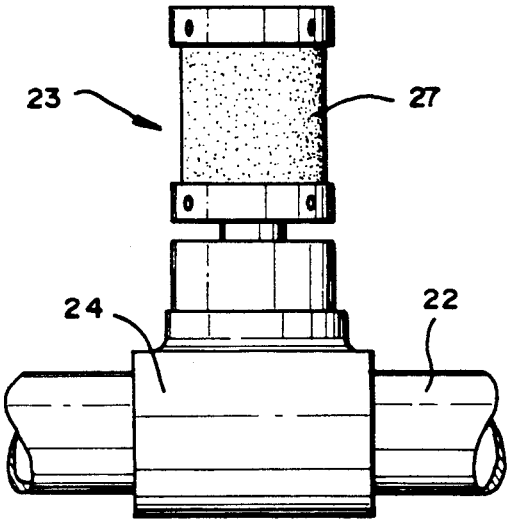
FIG. 3a
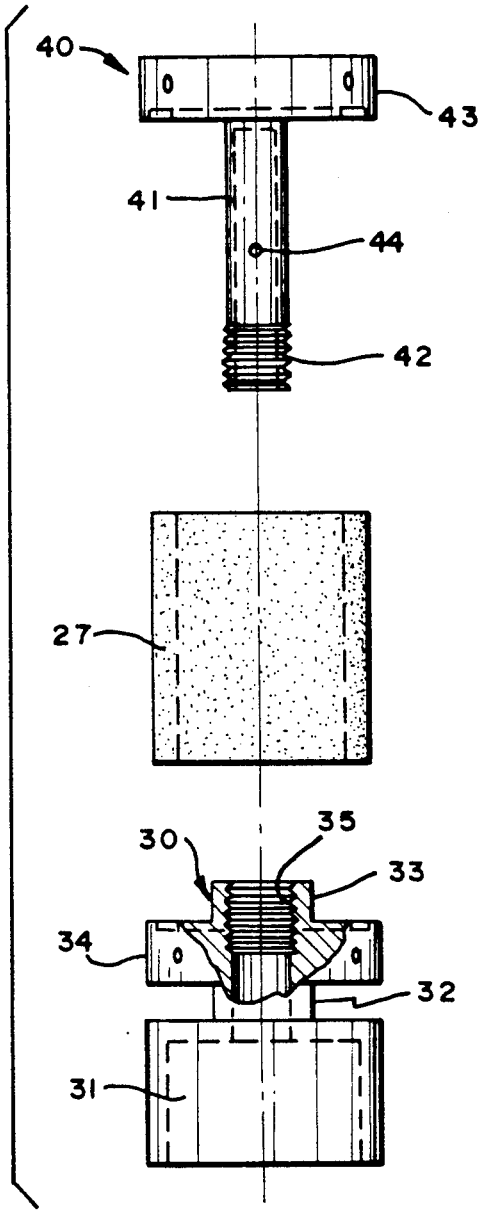
FIG. 3b
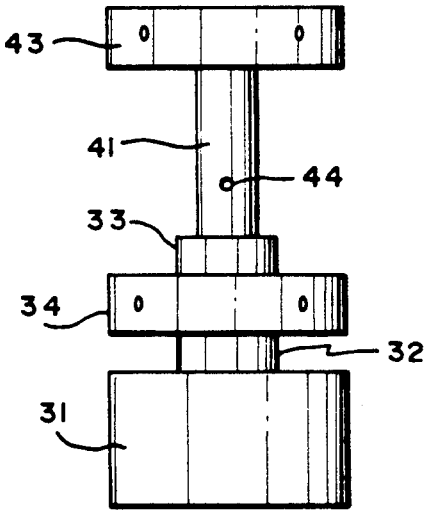
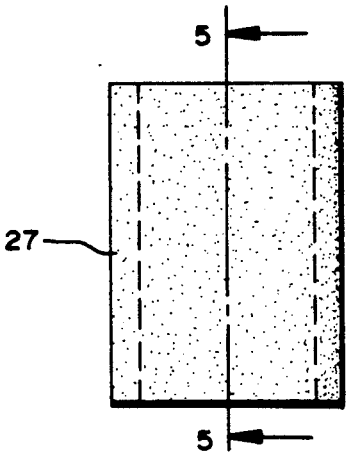
FIG. 4
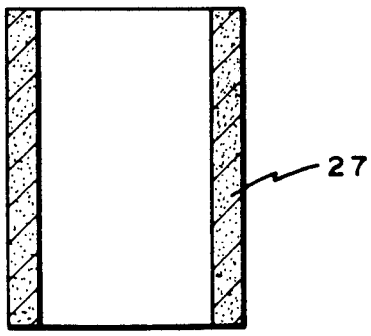
FIG. 5

PROCESS FOR STRIPPING LIQUID SYSTEMS AND SPARGER SYSTEM USEFUL THEREFOR

BACKGROUND OF THE INVENTION

The present invention relates to a process for the removal of undesirable materials from liquid systems and more particularly to a process for the removal of unreacted raw materials and unwanted by-products from liquid systems. The process comprises the delivery of a compressed, inert gas through the pores of a sintered porous sparger element and into a liquid system in the form of very small gas bubbles, referred to hereinafter as micro bubbles.

It is well-known to utilize inert gas sparging or stripping for removal of unreacted raw materials and unwanted by-products from chemical reactors and various processing tanks, such as pressure reactors, mixing or blending tanks and holding tanks. Stripping effectiveness is dependent upon good mass transfer between the inert gas and the liquid; typically, the higher the gas-liquid contact, the more efficient is the stripping.

Conventional sparger systems consist of an inert gas being dispersed into a liquid tank by means of nozzles, small holes in straight pipes or perforated rings or plates. To maintain a small gas bubble size, to prevent the gas bubbles from coalescing, and to maximize gas dispersion in the liquid, these conventional sparging systems depend, to a large extent, upon agitation, thereby necessitating the use of impellers, turbine impeller mixers or the like. The stripping effectiveness of these systems is also dependent on the volumetric flow rate and velocity of the stripping gas, orifice size and pressure drop across the orifice, as well as the physical properties (surface tension, density, viscosity) and temperature of the liquid mass to be stripped. Stripping effectiveness may be determined by the total length of time and total amount of inert gas necessary to achieve a product quality target. Product quality targets include such factors as removal of volatile materials to meet a flash point or removal of water from a reaction product.

Existing conventional sparging systems have certain limitations resulting in lengthened cycle time to obtain the necessary product quality targets and excessive use of the stripping gas. These limitations are particularly evident when conventional sparging techniques are utilized in liquid systems having high viscosities as such systems are much more difficult to strip than low viscosity liquids. As used in this specification and in the appended claims, the phrases "viscous liquid systems" and "systems having a high viscosity" are meant to describe those system or compositions having a viscosity greater than about 200 Cst., and typically greater than about 350 Cst., at 100° C., for example, from about 750 Cst. to about 2,000 Cst. at 100° C. Liquid systems having high viscosities include, but are not limited to, liquid compositions which are adapted for use as additives in oleaginous compositions such as fuels and lubricating oils. Among such high viscosity liquids there may be mentioned ashless and ash-containing dispersants such as borated and unborated polyisobutylene succinimides; anti-oxidant, anti-wear and/or anti-corrosion additives such as zinc dialkyldithiophosphates (ZDDP); and multi-functional viscosity modifiers, such as a blend of ethylene-propylene copolymer succinic anhydride and polyisobutylene succinic anhydride which has been aminated and then sulfonated.

The use of sintered porous materials to enhance sparging is also well known. For instance, porous spargers have been employed in aeration processes to diffuse air or other gases into various liquids (see generally U.S. Pat. Nos. 1,405,775, 2,639,131, 3,970,731, 4,105,725, 4,261,932, and 4,655,915). Additionally, porous elements have been used in the carbonation of liquids (U.S. Pat. Nos. 2,250,295 and 3,958,945). Further, as disclosed in U.S. Pat. Nos. 4,399,028 and 4,735,709, porous spargers have been effective in froth flotation systems.

SUMMARY OF THE INVENTION

It is an object of the invention to provide a new process for stripping unwanted materials and unreacted by-products from liquid systems.

It is another object of the invention to provide a new process for stripping unwanted materials and unreacted by-products from liquid systems having high viscosities.

Another object of the invention is to provide a new process for stripping unwanted materials and unreacted by-products from liquid systems which consumes lesser amounts of stripping gas than conventional sparging systems.

A further object of the invention is to provide a new process for stripping unwanted materials and unreacted by-products from liquid systems which increases the contact surface between the stripping gas and the material to be removed.

Still a further object of the invention is to provide a new process for stripping unwanted materials and unreacted by-products from liquid systems which results in shorter batch cycle times and greater production capacities.

Yet another object of the invention is to provide a new process for stripping unwanted materials and unreacted by-products from liquid systems which disperses smaller sized bubbles and more radial flow of the bubbles than in conventional systems.

It is an additional object of the invention to provide a new process for stripping unwanted materials and unreacted by-products from liquid systems which is less dependent on mechanical agitation of the systems to maintain small bubble size, thereby facilitating simpler equipment construction and process design and resulting in less costly systems.

The above and other objects and advantages are accomplished by providing a process for the removal of undesirable materials from liquid systems, and more particularly for the removal (i.e. stripping or sweeping) of unreacted raw materials and unwanted by-products from liquid systems, including viscous chemical reaction mixtures, which utilizes a modified sparger system (MSS) comprising a sintered porous material (for instance, metal, ceramic, glass or plastic) in the form of a ring, plate or tube, and preferably in the form of a short cylindrical tube, which is connected in fluid communication to a gas delivery apparatus, such as a gas delivery pipe, by means of a Tee coupler. This modified sparger element can be placed in a vessel in one or several locations, depending on several factors, including the vessel (i.e. tank) geometry, the gas consumption requirements of the systems, and the like.

BRIEF DESCRIPTION OF THE DRAWINGS

FIGS. 3, 3*a* and 3*b* illustrate one embodiment of a porous sintered sparging device according to the present invention, FIG. 3*a* being an exploded view of FIGS. 3*b* including a porous element 27 (which is shown in FIG. 3);

FIG. 4 depicts the sintered porous element in the form of a cylindrical tube; and FIG. 5 is a cross section of FIG. 4 taken along line 5—5 thereof.

DETAILED DESCRIPTION OF THE PREFERRED EMBODIMENT

The present invention relates to a process for the removal of undesirable materials from a liquid system such as a stripping tank, a mixing or blending tank or a pressure reactor. More particularly, the present invention relates to a process for the removal of unreacted raw materials and unwanted by-products from liquid systems such as viscous chemical reaction product mixtures.

Figure 1:
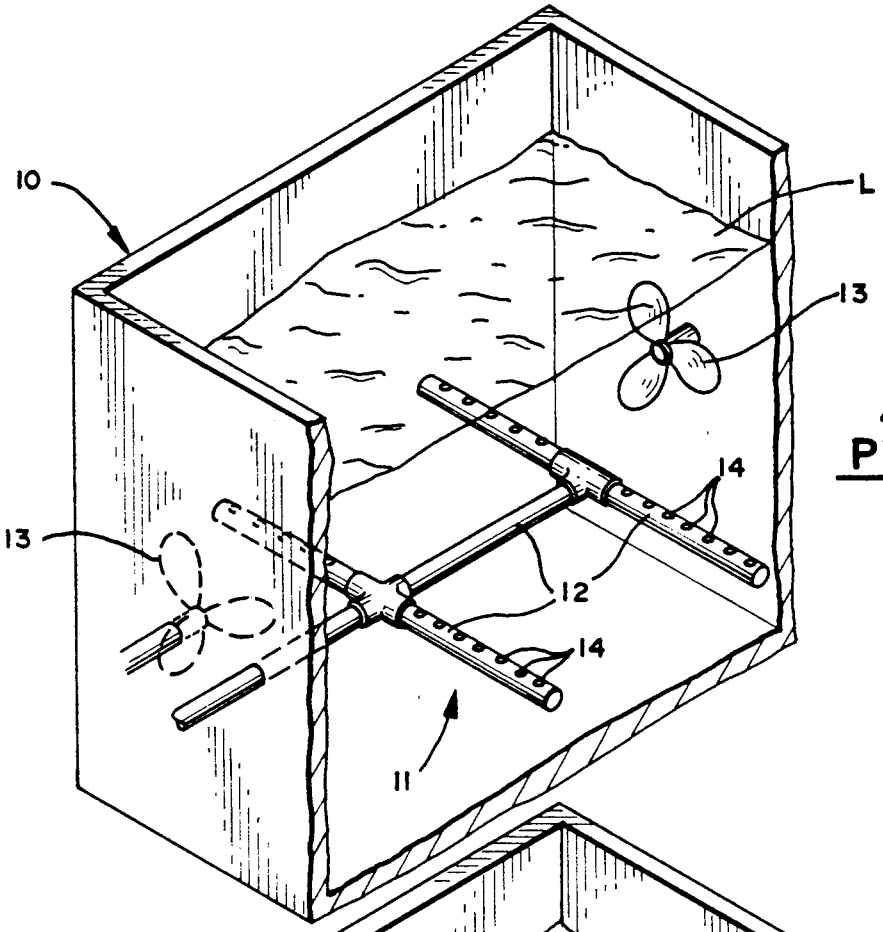
FIG. 1 PRIOR ART
FIGS. 1 schematically illustrates one type of a conventional sparging system that has been used for stripping reaction masses.

Referring to the drawings, and particularly to FIG. 1, there is shown a conventional sparger system located near the bottom of a tank 10 comprising a network or manifold 11 of gas delivery pipes 12. Small holes or perforations 14 are provided through the pipes 12 along the lengths thereof to effect the passing of an inert gas into a liquid L disposed in the tank 10. In order to maintain a relatively small size of the gas bubble being dispersed through the perforations 14, and to prevent the gas bubbles from coalescing, agitation is necessary. Accordingly, the tank 10 is also shown as being equipped with conventional agitation means, such as impellers 13. The impellers may be powered by any suitable means such as a motor or turbine (not shown).

Figure 2:
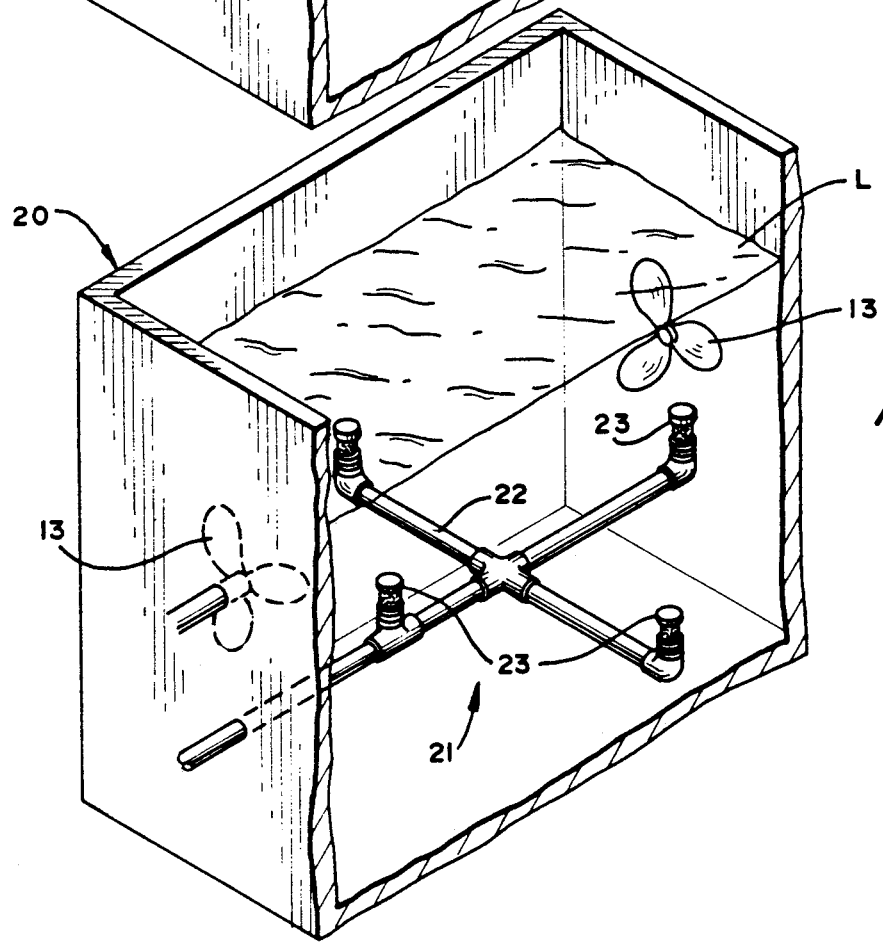
FIGS. 2 corresponds generally to FIG. 1, and schematically illustrates one embodiment of a modified sparger system in accordance with the present invention.

Referring now to FIG. 2, there is shown one embodiment of a modified sparger system (MSS) in accordance with the present invention. The MSS is shown in a liquid-filled tank 20, such as a reactor, stripping vessel or the like, preferably near the bottom thereof. The MSS comprises a gas delivery manifold 21 of pipes 22 having one or more porous gas discharge or sparger elements 23 mounted in fluid dispersing communication therewith. The sparger elements 23, which are shown more clearly in FIGS. 3, 3*a* and 3*b*, comprise a Tee coupler 24, a tubular cylindrical gas distributive support means, and a sintered porous element 27.

The gas distributive support means may be viewed as comprising two sections 30 and 40 (FIGS. 3, 3*a* and 3*b*). Section 30 consists of a first or inner end 31 which is adapted to be secured to Tee coupler 24, a narrower tubular middle section containing a gas supply pipe 32 and an outer or distal end 33 having annular clamping means in the form of a flange 34. The outer end 33 of section 30 further comprises connecting means in the form of a threaded female portion 35. Section 40 comprises a tubular gas supply pipe 41, the innermost end of which is provided with connecting means in the form of threads 42 for threading engagement with the threaded female portion 35 of distal end 33 section 30. The outer or distal end of pipe 41 of section 40 is capped by a clamping means such as annular flange 43. The tubular gas supply pipe 41 of section 40 contains gas liberation or distribution holes 44 for the release of gas therefrom.

The sintered porous element 27, best seen in FIGS. 4 and 5, comprises a short cylindrical tube of a sintered porous material such as metal, ceramic, glass or plastic, but preferably metal. The porous element 27 is prepared by sintering particles of metal, or the like to form a solid structure having a pore size on the order of from about 5 microns to about 55 microns, typically 5 to 25 microns, and preferably 7 to 20 microns. The porous elements 27 are available commercially, for example, from Pall Porous Metals Filter Corporation.

The tubular sintered porous element 27 is fashioned to be fitted over gas supply pipe 41. Once element 27 is fitted on to the gas supply pipe 41, the two housing sections 30 and 40 are then fastened via threaded member 35 and 42. The sparger assembly is then secured to Tee coupler 24, which in turn is connected to gas delivery manifold, for example, by a welded or threaded connection.

In operation, an inert gas, such as nitrogen, is delivered through the manifold 21 to the gas delivery pipes 22 located in tank 20 and to the various Tee couplers 24 of sparger elements 23. The gas then enters the gas supply pipes 32 from where it is released through the sintered porous elements 27 via the liberation holes 44 in the supply pipes 41 and is dispersed in the form of minute micro bubbles into the liquid being stripped. Bubble size and velocity can be varied by changing the sintered sparger elements, e.g. by changing the pore size, or by changing the supply gas pressure and the volumetric flow rate. For instance, an increase in the volumetric flow rate, yields better radial distribution of the gas bubbles while a decrease in the volumetric flow rate tends to cause coalescing of the bubbles. For liquid compositions having a viscosity on the order of from about 750 Cst. to about 2,000 Cst., at 100° C., stripping is effective when using sparger elements having a pore size on the order of from about 5 to about 55 microns, and a volumetric flow rate in the range of 20 kg./hr. to about 150 kg./hr.

As seen in FIG. 2, more than one sparger element can be employed in the present system. The number of sparger elements and placement thereof is dependent on several factors, including the identity and properties of the liquid being stripped, the geometry of the vessel being used, and the gas consumption requirements of the systems.

The following examples are provided to demonstrate the practice of the present invention and to illustrate the superior results that are achieved by using the modified sparger system of the present invention. The examples are intended to be illustrative of preferred embodiment of the invention.

EXAMPLE 1

A multifunctional viscosity modifier was prepared as follows:

A vented tank measuring 30 feet high and 10 feet in diameter was provided with a sparger system comprising a gas delivery manifold having four sparger element mounted in fluid communication therewith. Each sparger element comprised a Tee coupler, a tubular cylindrical gas distributive support means and a sintered porous element. The gas delivery manifold was prepared from 1.5 inch Schedule 40 steel pipe, the Tee coupler was a standard 1.5 inch Schedule 40 Tee and the gas distributive support means had an outside diameter of approximately 1.9 inches and, an inside diameter of approximately 1.61 inches. The sintered porous element employed was a stainless steel sintered cylinder supplied by Pall Porous Metals Filter Corporation, identified as PSS Cylinder, #C14-06-H, having a density of 4.7 gm.c/$m^3$ and a pore size of 13 microns. This sparger system was situated approximately one foot above the floor of the tank. The tank was also equipped with two three-blade impeller agitators, located approximately three feet above the tank floor. The agitators are provided to supplement the distributive action of the sparger system.

The tank was supplied with 13.5 tons of a polymer solution comprising a mixture of ethylene-propylene succinic anhydride-polyisobutylene succinic anhydride (EPSA/PIBSA). The EPSA/PIBSA mixture in pure form has a viscosity of 750 Cst., at 100° C. (180 Cst. at 150° C.). In storage and transport, residual water in the EPSA/PIBSA mixture tends to hydrolyze the anhydride, resulting in the formation of the acid from having a higher viscosity. In this instance, the viscosity of the starting solution was 980 Cst., at 100° C. Because the anhydride is a more desirable starting reactant, simultaneous to the solution being heated to 150° C., water was stripped from the liquid mass by the combined action of the mixers and the small $N_2$ bubbles generated by the sparger system. The gas bubbles were produced by a compressed stream of $N_2$ gas flowing at a rate of 30 Kg./hr. After a stripping time of 6.5 hours, the flow of $N_2$ was terminated. The liquid mass had a water content of 0% (less than 200 ppm) and a viscosity of 180 Cst. (750 Cst. at 100° C).

The dehydrated solution was aminated by charging the tank with 0.125 tons of diethylene triamine (DETA). Water liberated during the amination step was stripped from this mixture by the combined action of the mixers and the small $N_2$ bubbles generated by the sparger system. The compressed stream of $N_2$ gas flowed at a rate of 100 Kg./hr. After two hours of stripping, the liquid mass contained less than 200 ppm water and the viscosity was determined to be 1580 Cst. at 100° C.

The resulting solution was then sulfonated by charging the tank with 0.45 tons sulfonic acid. Residual water is generated during the sulfonation step. The water precipitated by this reaction was stripped from this mixture by the same method described above. The flow rate of the comprised stream of $N_2$ gas was 100 Kg./hr. After an $N_2$ strip of two hours, the water content of the liquid mass was 0% (less than 200 ppm). The viscosity was determined to be 1600 Cst. at 100° C.

The reaction product was subsequently blended back to the target value viscosity of 950 Cst. at 100° C. by adding 2.2 tons of a mineral base oil.

COMPARATIVE EXAMPLE 1

The procedure of Example 1 was repeated, except that the tank was provided with a gas delivery manifold having small holes (approximately ⅜ inch in diameter) perforated along the length thereof, rather than being equipped with the sintered porous elements that were used in Example 1.

The starting EPSA/PIBSA mixture was stripped of residual water by the combined action of the agitators and the gas bubbles dispersed into the liquid mass by the small perforations in the gas delivery manifold. However, because a perforated gas delivery manifold was used instead of the porous sparger elements that were used in Example 1, the $N_2$ flow rate had to be increased to 50 Kg./hr., rather than 30 Kg./hr. as was employed in Example 1. After a stripping time of 6.5 hours, during which the starting solution was heated to 150° C., the flow of $N_2$ was terminated. The liquid mass had a water content of 0% (less than 200 ppm) and a viscosity of 180 Cst. (750 Cst. at 100° C).

The dehydrated solution was aminated by charging the tank with 0.125 tons of DETA. Water liberated during the amination step was stripped by the combined action of the agitators and the gas bubbles dispersed into the liquid mass by the small perforations in the gas delivery manifold. The gas bubbles were produced by a stream of $N_2$ flowing at a rate of 280 Kg./hr., as opposed to a flow rate of 100 Kg./hr. for Example 1. After a two hour strip time, the liquid mass contained trace amounts of water (less than 200 ppm). The viscosity was determined to be 1580 Cst. at 100° C.

The resulting solution was then sulfonated by charging the tank with 0.45 tons sulfonic acid. Water formed during sulfonation was stripped from this mixture by the same method in the previous steps stripping at a $N_2$ stripping flow rate of 280 Kg/hr., as opposed to 100 Kg./hr. for the equivalent step in Example 1. After an $N_2$ strip of two hours, the liquid mass contained trace amounts of water (less than 200 ppm). The viscosity was determined to be 1600 Cst. at 100° C.

The reaction product was subsequently blended back to the target value viscosity of 950 Cst. at 100° C. by adding 2.2 tons of base oil.

EXAMPLE 2

A dispersant was prepared as follows.

A vented tank having the same dimensions and hardware as in Example 1 was supplied with 21.4 tons of PIBSA which had a viscosity of 900 Cst. at 100° C. Over a period of two hours, 15.6 tons of base oil were added to the tank. This starting mixture had a viscosity of 64 Cst. at 100° C. The mixture was heated to 150° C., resulting in a viscosity of 20 Cst. at 150° C. 1.9 tons of polyamine (PAM) were charged to the tank over a 4 hour period. After amination, the liquid mass had a water content of 0.2% due to water liberated during the amination reaction. Water was then stripped from the liquid mass by the combined action of the mixers and the small $N_2$ bubbles generated by the sparger system. The gas bubbles were produced by a compressed stream of $N_2$ gas flowing at a rate of 30 Kg/hr. After a stripping time of 1 hour, the flow of $N_2$ was terminated. The liquid mass had a water content of 0.03%.

The resulting solution was then borated by charging the tank with 0.8 tons of boric acid over a 30 minute period. The liquid mass had a water content of 0.2% due to water liberated during the boration reaction. Water was stripped from this mixture by the combined action of the mixers and the small $N_2$ bubbles generated by the porous sparger system. The compressed stream of $N_2$ gas flowed at a rate of 30 Kg./hr. After one hour of stripping, the liquid mass had a water content of 0.05% and the viscosity was determined to be 131 Cst. at 100° C.

The reaction product was subsequently blended back to the target value viscosity of 64 Cst. at 100° C. by adding 14.8 tons of a mineral base oil.

COMPARATIVE EXAMPLE 2

The procedure of Example 2 was repeated using the tank described in Comparative Example 1. The tank was supplied with 21.4 tons of PIBSA which had a viscosity of 900 Cst. at 100° C. Over a period of two hours, 15.6 tons of base oil were added to the tank. This starting mixture had a viscosity of 64 Cst. at 100° C. The mixture was heated to 150° C., resulting in a viscosity of 20 Cst. at 150° C. 1.9 tons of polyamine (PAM) were charged to the tank over a 4 hour period. After amination, the liquid mass had a water content of 0.2% due to water liberated during the amination reaction. Water was then stripped from the liquid mass by the combined action of the agitators and the gas bubbles dispersed into the liquid mass by the small perforations in the gas delivery manifold. The gas bubbles were produced by a stream of $N_2$ flowing at a rate of 130 Kg./hr., as opposed to only 30 Kg./hr. for Example 2. After a stripping time of 1 hour, the flow of $N_2$ was terminated. The liquid mass had a water content of 0.05%. The resulting solution was then borated by charging the tank with 0.8 ton boric acid over a 30 minute period. The liquid mass had a water content of 0.2% due to water liberated during the boration reaction. Water was then stripped by the combined action of the agitators and the gas bubbles dispersed into the liquid mass by the small perforations in the gas delivery manifold. The gas bubbles were produced by a stream of $N_2$ flowing at a rate of 130 Kg./hr., as opposed to only 30 Kg./hr. for Example 2. After one hour of stripping, the liquid mass had a water content of 0.10%. The viscosity was determined to be 134 Cst. at 100° C.

The reaction product was subsequently blended back to the target value viscosity of 64 Cst. at 100° C. by adding 14.8 tons of a mineral base oil.

EXAMPLE 3A

A zinc di(ethyl hexyl) dithiophosphate (ZDDP) product was prepared as follows:

A vented tank measuring 11 feet high and 7 feet in diameter was provided with a sparger system comprising a gas delivery manifold having six sparger elements mounted in fluid communication therewith. Each sparger elements comprised a Tee coupler, a tubular cylindrical gas distributive support member and a sintered porous element. The gas delivery manifold was prepared from 1.5 inch Schedule 40 steel pipe, the Tee coupler was a standard 1.5 inch Schedule 40 Tee and the gas distributive support means had an outside diameter of approximately 1.9 inches and an inside diameter of approximately 1.61 inches. The sintered porous element employed was a stainless steel sintered cylinder supplied by Pall Porous Metals Filter Corporation, identified as PSS Cylinder, #C14-06-H, having a density of 4.7 gm.cm/$^3$ and a pore size of 13 microns. This sparger system was situated approximately one foot above the floor of the tank. The tank was also equipped with a 10-horse power mixer suspended from the roof of the tank, the mixer head being immersed in the liquid mass. The mixer is provided to supplement the distributive action of the sparger system.

The tank was supplied with 4.2 tons of a raw concentrated ZDDP reaction product having a water content of 4.0%, of a reaction temperature of 62° C. and having a viscosity of 15.5 Cst. at 100° C. Water was stripped from the liquid mass by the combined action of the mixers and the small $N_2$ bubbles generated by the sparger system. The gas bubbles were produced by a compressed stream of $N_2$ gas flowing at a rate of 20 Kg./hr. After a stripping time of 6 hours, the flow of $N_2$ was terminated. The liquid mass had a water content of 2.5%.

The reaction product was subsequently transported to a filtration tank for further processing.

EXAMPLE 3B

The procedure of Example 3A was repeated except that the starting ZDDP reaction product has a water content of 4.8% at a reaction temperature of 73° C. Employing the same stripping method and conditions, the liquid mass had a water content of 1.3% when the flow of $N_2$ gas was terminated after the 6 hour strip time.

COMPARATIVE EXAMPLE 3

The procedure of Example 3A was repeated, except that the tank was provided with a gas delivery manifold having ⅜ inch diameter holes perforated along the length thereof, rather than the sparger system having the sintered porous elements.

The starting ZDDP reaction product had a water content of 4.5% at a reaction temperature of 60° C. s Water was stripped from the liquid mass by the combined action of the agitators and the gas bubbles dispersed into the liquid mass by the small perforations in the gas delivery manifold. The gas bubbles were produced by a stream of $N_2$ flowing at a rate of 60 Kg./hr., as opposed to the 20 Kg./hr. rate used in Examples 3A and 3B. After a stripping time of 36 hours (a stripping time of only 6 hours was used in Examples 3A and 3B), the flow of $N_2$ was terminated. The liquid mass had a water content of 2.2%.

The examples provided above clearly demonstrate the superior results achieved by using the modified sparger system of the present invention. Thus, in Examples 1 and 2, products having a similar very low water content as were achieved with comparative Examples 1 and 2, were obtained over the same period of time using very significantly lower flow rates of the $N_2$ stripping gas. Similarly, when comparing the results of Examples 3A, 3B with Comparative Example 3, wherein the liquid mass had a relatively low initial viscosity, dramatically lower rates of flow of the stripping gas and stripping time were used in Examples 3A and 3B than in Comparative Example 3 to achieve similar target product quality. Consequently, it should be apparent that the modified sparger system of the present invention utilizes the stripping gas far more efficiently than the comparative systems, thereby reducing costs of operation.

The principles, preferred embodiment, and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A process for stripping water from a viscous liquid reaction mixture having an initial viscosity of at lest about 350 Cst at 100° C., consisting essentially of: introducing the viscous liquid reaction mixture into a tank; and feeding a stripping bas into the viscous reaction mixture through the pores of a sintered porous sparger element, said gas being in the form of micro gas bubbles as it is introduced into the reaction mixture; and, optionally mechanically stirring the reaction mixture while said gas bubbles are being introduced therein.

2. The process of claim 1, wherein the initial viscosity of the reaction mixture is from about 750 Cst. to about 2000 Cst. at 100° C.

3. The process according to claim 2, wherein the reaction mixture being stripped is a zinc dialkyldithio phosphate composition which is adaptable for use as an additive in oleaginous compositions.

4. The process according to claim 2, wherein the reaction mixture being stripped is a an ashless or ash containing dispersant suitable for use as an additive in oleaginous compositions.

5. The process according to claim 2, wherein the reaction mixture being stripped is a multi-functional viscosity modifier suitable for use as an additive in oleaginous compositions.

6. The process according to claim 1, wherein the sintered porous sparger element is composed of a material selected from the group consisting of metal, ceramic, glass and plastic and is characterized by a pore size on the order of from about 5 to about 55 microns.

7. The process according to claim 6, wherein the sintered porous sparger element is composed of metal.

8. The process according to any one of claims 1–7, wherein the stripping gas is inert with respect to the liquid being stripped.

9. The process of claim 8, wherein the stripping gas comprises nitrogen.

* * * * *